US007581554B2

(12) United States Patent
Glasser

(10) Patent No.: US 7,581,554 B2
(45) Date of Patent: Sep. 1, 2009

(54) CONTAINERIZED FRAME AND MEANS FOR ITS TELESCOPIC PROJECTION AND RETRACTION

(76) Inventor: Jerome Glasser, 16 Sunset Ter., Maplewood, NJ (US) 07040

( * ) Notice: Subject to any disclaimer, the term of this patent is extended or adjusted under 35 U.S.C. 154(b) by 235 days.

(21) Appl. No.: 11/163,557

(22) Filed: Oct. 22, 2005

(65) Prior Publication Data

US 2007/0089768 A1 Apr. 26, 2007

(51) Int. Cl.
*A45B 25/02* (2006.01)

(52) U.S. Cl. ..... 135/19; 135/15.1; 135/25.41

(58) Field of Classification Search ..... 135/20.3, 135/25.33, 34.2, 43, 15.1, 25.41
See application file for complete search history.

(56) References Cited

U.S. PATENT DOCUMENTS

| | | | | |
|---|---|---|---|---|
| 2,091,676 | A * | 8/1937 | Fliegner | 135/25.31 |
| 3,435,836 | A * | 4/1969 | Sergio | 135/22 |
| 3,534,752 | A * | 10/1970 | Sergio | 135/22 |
| 3,709,238 | A * | 1/1973 | Leopoldi et al. | 135/15.1 |
| 6,273,111 | B1 * | 8/2001 | Weiss et al. | 135/25.41 |

* cited by examiner

*Primary Examiner*—David Dunn
*Assistant Examiner*—Noah Chandler Hawk

(57) ABSTRACT

A containerizable frame structure having a motion conversion means for telescopically projecting it out of and retracting it into a container. Some applications include umbrellas, banners, signs, portable wall structures, and tables.

15 Claims, 15 Drawing Sheets

CONTAINERIZED FRAME AND MEANS FOR ITS TELESCOPIC PROJECTION AND RETRACTION

FIELD OF THE INVENTION

The present invention relates to improvements in the field of multi-use frames, and in-particular, frames which can be projected out of and/or retracted into containers, and more particularly, those having material at least partially attached and perhaps removeably attachable. One of the primary applications for the invention of this disclosure is in the field of umbrellas and parasols, but this invention is equally useful for portable wall-type screens such as those used in tradeshows. It may also have military or satellite communications applications in the form of retractable items such as antennas.

BACKGROUND OF THE INVENTION

Some types of containerized frame constructions are known. Many of the containerized frame prior art constructions may be found in the umbrella field. Heretofore, each prior disclosure, however, suffers from one or more drawbacks, some of which include: difficulty in closing during high winds; difficulty in closing primarily due to the high potential for finger-pinching; relatively easy frame breakage in high winds due to frame inflexibility; the requirement for a relatively spacious area in which to accomplish the frame opening and closing, which generally proves exceedingly inconvenient and uncomfortable in crowded areas or when entering or exiting a vehicle; the requirement that the container length be significantly greater than the length of the frame main ribs in order that the frame and its projection-retraction mechanism may fit substantially fully within the container when in the stored condition.

Prior art in the umbrella field includes U.S. Pat. No. 3,435,836 (1969) to VANZINI and U.S. Pat. No. 3,709,238 (1973) to LEOPOLDI. These prior art embodiments necessarily require a container length significantly in excess of the longest frame main rib length in order that the projection-retraction mechanism, as well as the frame, can fit interior to the container when the frame is in the closed, stored condition. Since every one unit of a frame's rib length yields two units of length of coverage when the frame is opened, the optimal condition for a containerized frame is one in which container length does not exceed frame main rib length. These prior art inventions, therefore present a major deficiency. For ease of storage of the entire device when not in use, and for ease of portability, it is most advantageous to reduce the size of the container to as great an extent as possible without reducing main rib length.

U.S. Pat. No. 18,500 (1857) to CROSBY provides an almost one-hundred percent allocation of the length of the container for storage of the frame main ribs. Moreover, the upper collar and the free end of the lower collar's stabilizing bar have a relationship permitting their engagement and disengagement. However, the engagement finalizing the opening process and the disengagement initiating the closing process can only be effected by direct contact, generally by use of the fingers. This necessary pulling and pushing action is neither particularly comfortable, nor graceful. Furthermore, the process of returning the umbrella to its stored condition is an awkward, unwieldy one, requiring that the frame be pushed, rather than pulled back into the container. Although this method seems to be eventually effective in allowing the user to re-store the frame and its cover, completion of the storage process seems only attainable after a significant expenditure of effort and energy.

U.S. Pat. No. 3,534,752 (1970) to VANZINI incorporates a rotatable element into its design. However, the rotatable element functions exclusively, meaning only, during the closing process. Within that process, furthermore, its sole effect on the retraction of the cover-holding frame is through the rotation of the whole, entire frame in an attempt to effect an orderly roll up of the frame covering material so as to facilitate the re-entry of the frame and cover back into the container. This act of frame rotation is rendered totally unnecessary and obsolete merely by using material of a denier sufficiently thin that the amount of friction between the diameter of the container opening and the collective amount of material that must pass through the opening is reduced to a negligible level.

U.S. Pat. No. 389,806 (1888) to HALE, discloses a cane having an hollow section for storage of a flag or banner and does not suggest any rotatable elements.

U.S. Pat. No. 447,696 (1891) to MUEDHENK, disclosing a mechanism for projecting open and retracting closed a banner also discloses no rotatable elements whatsoever. In fact, it does not even provide for a protective container to encompass the projection-retraction rod and, thereby, subjects the rod to easy damage or breakage.

OBJECTS AND SUMMARY OF THE INVENTION

Some specialty umbrellas do achieve a certain, moderate success in attempts to solve one, perhaps two or even an ambitious three of the many factors that detract from the overall positive experience of umbrella or parasol use. Nevertheless, only the present invention allows for most if not all of the disadvantages surrounding umbrella and parasol use to be overcome. The invention of this disclosure allows for the production of a strong, compactly designed umbrella, parasol or wall-like screen or useful frame which can be telescopically projected out of and retracted into a container which, itself, serves a multiple of functions including shaft-pole for keeping the covering material-holding frame overhead when protection is desired, and storage chamber providing for the overall protection of the frame, the cover and the user when the frame and cover are not in use. This is accomplished by providing a mechanism that allows for a significant decrease, heretofore unknown, in the ratio of container length to frame main rib length when used as part of a projection-retraction means for a containerizable frame with attached cover material.

Accordingly, a primary object of this invention is to provide a mechanism that can be used as part of a strong, compact umbrella structure which allows for a frame and its cover to be projected out of and retracted into a container.

Another object of this invention is to provide a parasol sunshade having a protective sunscreen means such as a chemical coating which can be protected from damage through containerized storage.

A further object of this invention is to provide a mechanism that can be used as part of a strong, compact structure that can define a vertical screen-type wall structure.

A still further object of this invention is to provide a mechanism that can be used as part of a strong, compact structure that can define a horizontal screen-type table.

An even further object of this invention is to provide a mechanism that can be used as part of a strong, compact structure that can define a sign, flag, or banner.

Yet still another object of this invention is to provide a containerized frame which can be relatively inexpensively produced and which can function as a security club or stick.

Yet another, still further object of this invention is to provide a frame which may be useful as part of a satellite communications system.

Yet still another, further object of this invention is to provide a system which can function as a tent structure.

In accordance with an aspect of the present invention, the mechanism of this invention comprises an elongated container with an axial slit, a container cap for sealing the primary opening of the container, ribs and a frame cover material.

Also disclosed is a solid, elongated actuation shaft having its exterior configuration comprising a high helical spline. This exterior high helical spline configuration is constant until approximately ⅓ of the distance from the lower end of the actuation shaft at which point the helical spline configuration is reduced until it is discontinued.

A base is further disclosed for holding stable the end of the actuation shaft not having the discontinued helical configuration.

A rotatable rod is concentrically disposed along the axis of the actuation shaft, having an interior coactive with the exterior of the actuation shaft. Its exterior comprises a high helical spline configuration wound in the opposite direction to that of the actuation shaft. On the rotatable rod's lower end exterior, further, is a lip formed integral to its main body. From the bottom of this lip emanates a continuation of the main body of the rotatable rod. The exterior of this continuation, in contrast to the main body exterior, is totally smooth and cylindrical. This section accommodates the attachment of a lower lip-cap that serves to hold the drive force handle in contact with the rotatable rod. This lower lip-cap has a main body with a greater inner diameter than the outer diameter of the continuation of the main smooth body of the rotatable rod, and a smaller outer diameter than the rotatable rod upper lip.

A rotatable collar which is concentrically disposed along the axis of the rotatable rod, is disclosed having on its interior at least one narrow bridge connecting to an interior cylindrical or polygonally shaped ring engageable with the rotatable rod exterior. This interior ring has on its interior a configuration interactive with the high helical configuration on the exterior of the rotatable rod. The base of the rotatable collar is disclosed having an upper and a lower lip defining an area for accommodating a wire for attaching to the rotatable collar at least one frame rib-like element. There is also at least one pair of vertically aligned slots in the base lips to stabilize the at least one frame rib-like element after its attachment. Positioned over the base is an area narrower than the base which can accommodate the attachment of a cover material-holding ring.

Further disclosed is a stabilizing pole with at least one axial slit. This stabilizing pole is integrally attached to a lower collar with slots to accommodate the attachment of frame support-rib-like elements. The lower area of the lower collar part of the stabilizing pole comprises a lower lip slightly wider than the lower collar main body and interacts with a container annular rim to prevent the frame structure from exiting the container.

A tension-imparting element such as a spring, and a cap for the top of the stabilizing pole to keep the spring from separating away from the stabilizing pole, are also disclosed.

A drive force handle having a diameter sufficient to surround the container has a bridge narrow enough to fit slidably within the axial slit in the container. Attached to this bridge which projects into the handle interior, can be found an inner ring whose interior is wide-enough to surround the exterior of the first rotatable rod lower lip-cap.

The above and other objects, features and advantages of the present invention will become apparent from the following description thereof to be read in connection with the accompanying drawings.

BRIEF DESCRIPTION OF THE DRAWINGS

The invention is herein described, somewhat diagrammatically and by way of example only, with reference to the accompanying drawings, wherein.

REFERENCE NUMERALS IN DRAWINGS

Figure 1:
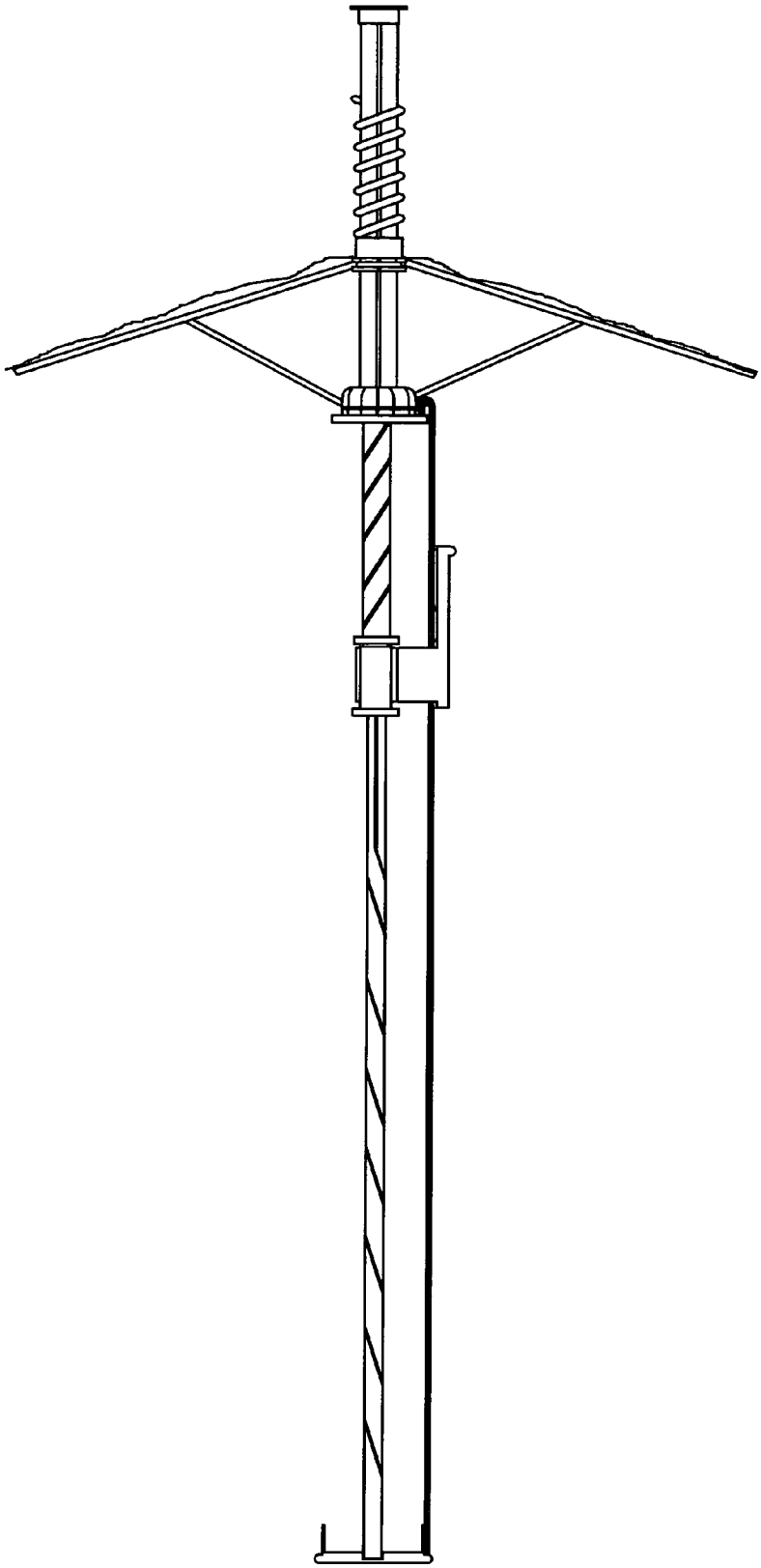
FIG. 1 is a side, interior view of a Frame fully opened and projected out of an elongated, circular Container.
Figure 2:
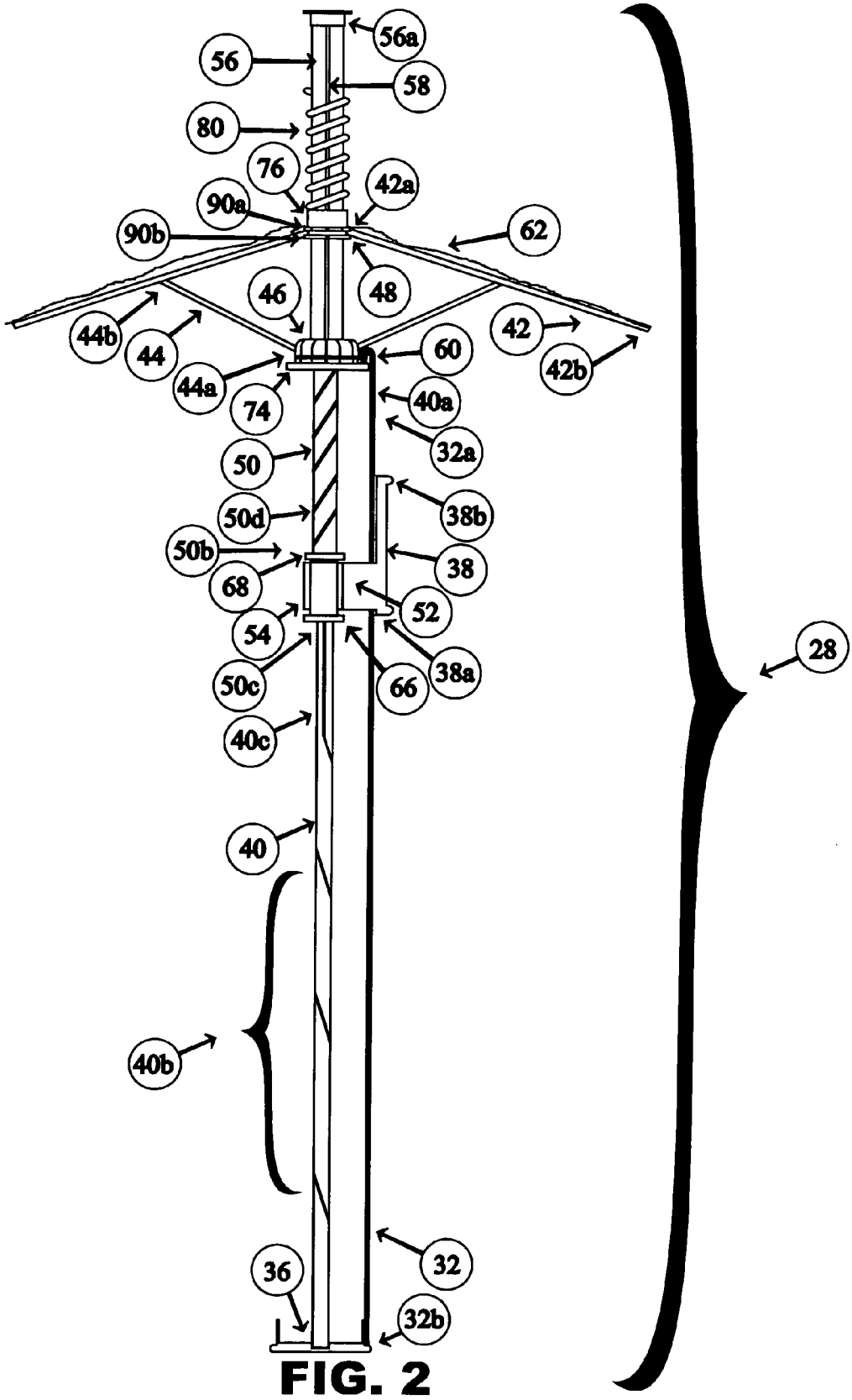
FIG. 2 is the same side view of the containerized cover-holding Frame of FIG. 1 fully opened and projected out of an elongated, circular Container, but with numbers.
Figure 3:
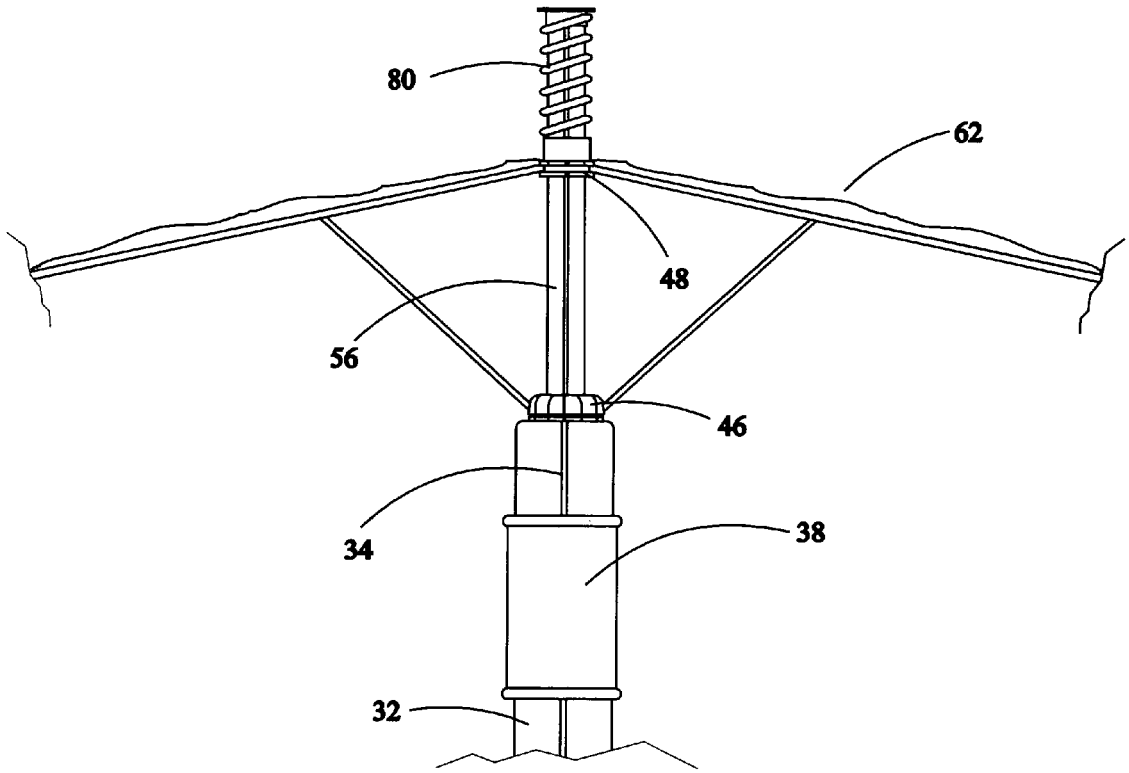
FIG. 3 is a side view of the containerized cover-holding Frame of FIG. 1 fully opened and projected out of an elongated, circular Container.
Figure 4:
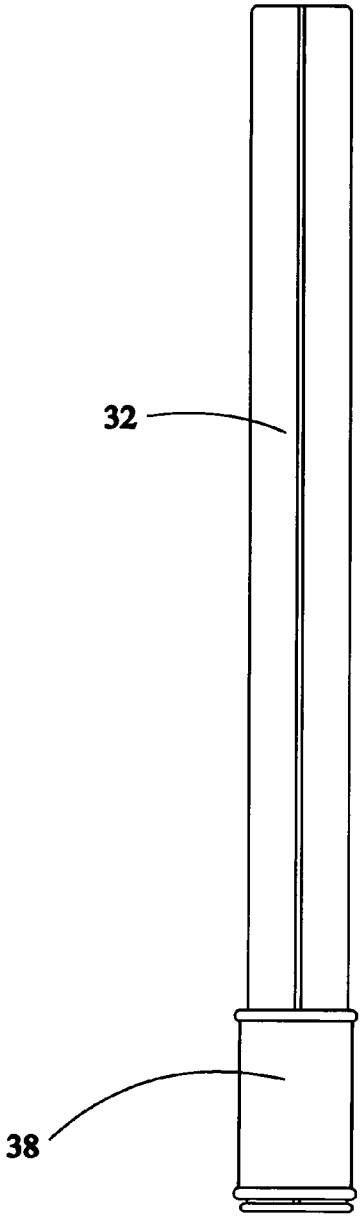
FIG. 4 is a side view of an elongated Container with the Frame in the stored position.
Figure 5:
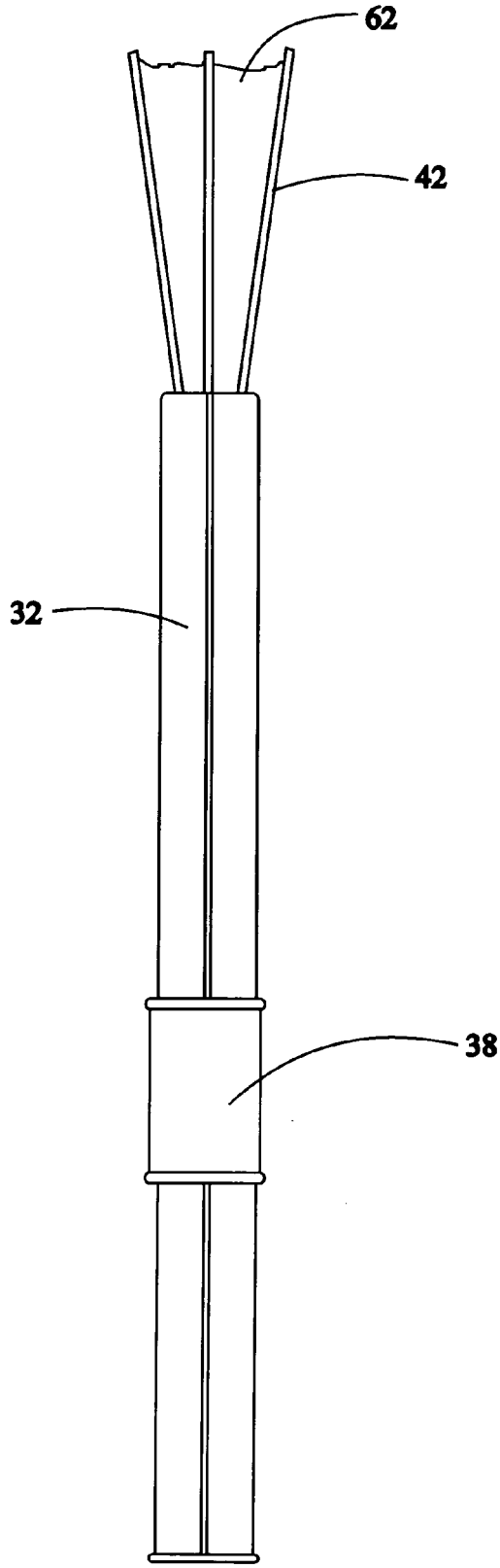
FIG. 5 demonstrates the initiation of the projection process for one version of a containerized Frame.
Figure 6:
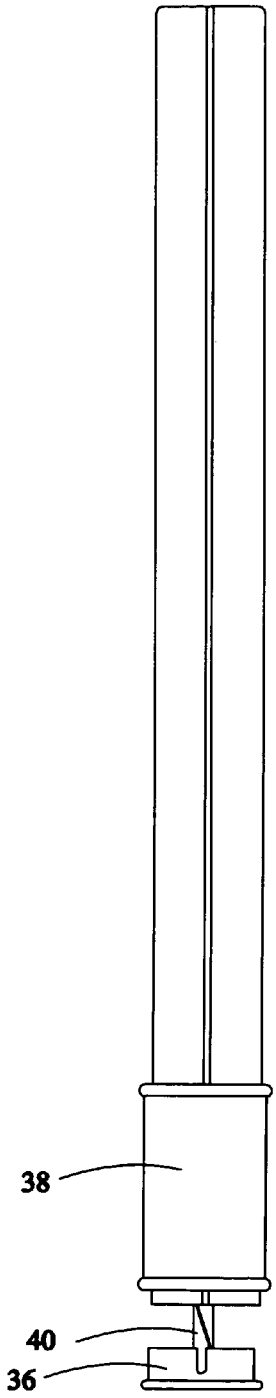
FIG. 6 shows the base separated from the container and attached to Actuation Shaft.
Figure 7:
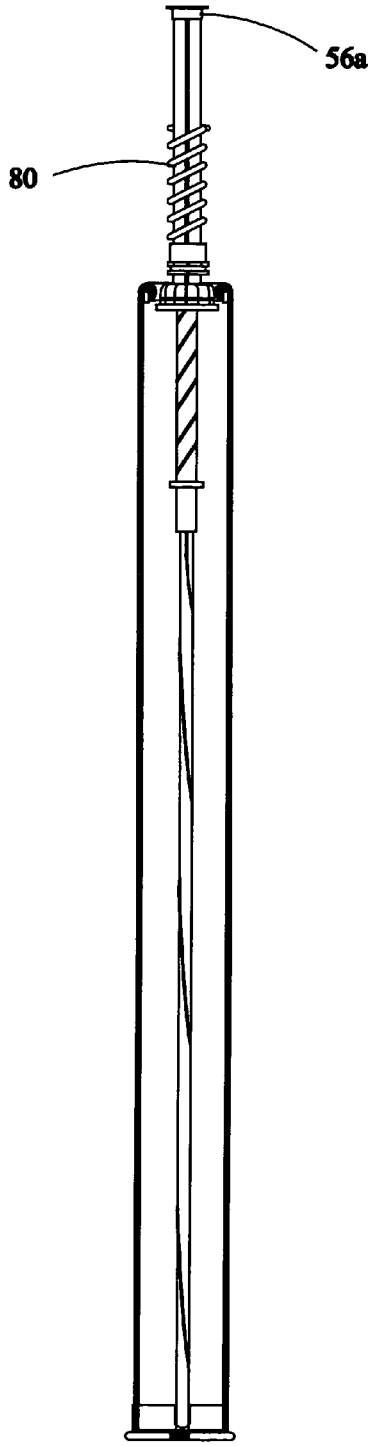
FIG. 7 shows is a side, interior view the Container and the projection/retraction mechanism.
Figure 8:
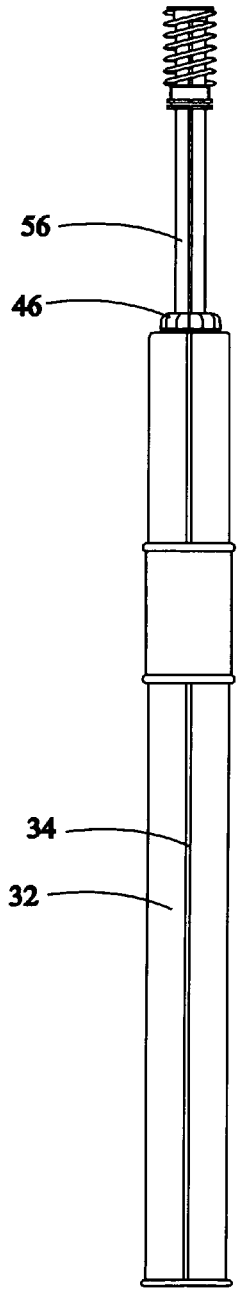
FIG. 8 shows the positioning of the Handle as well as Upper and Lower Collars in the fully opened position.
Figure 9:
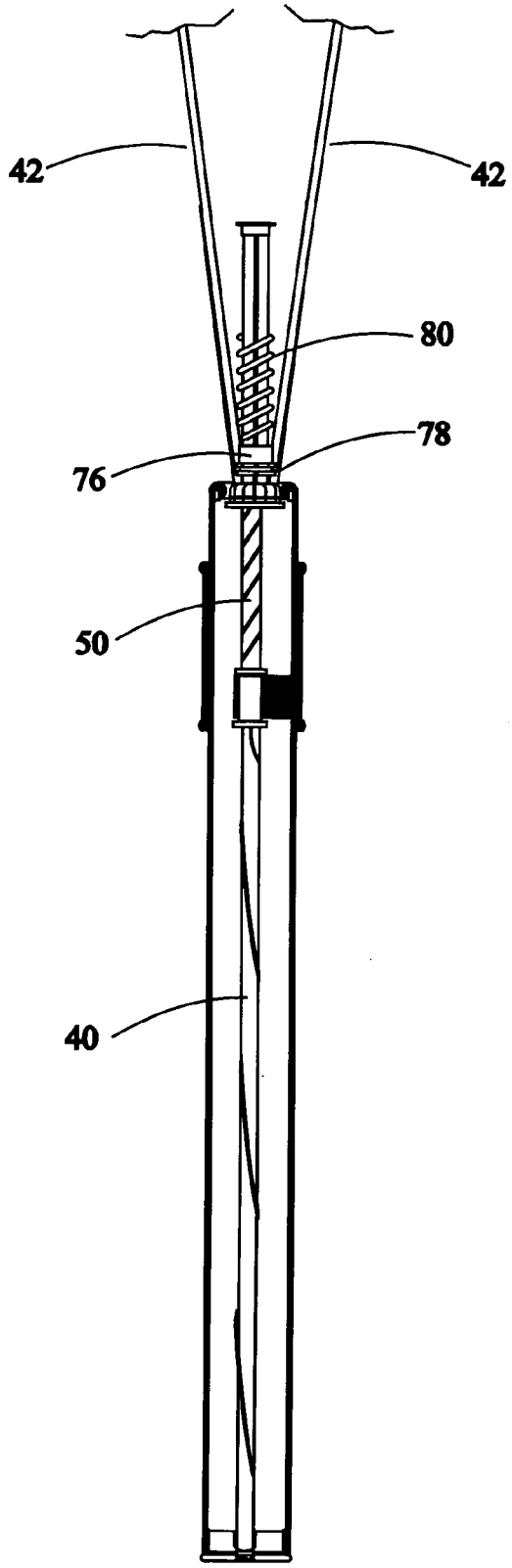
FIG. 9 shows the positioning of the projection/retraction mechanism at the point at which a Frame has substantially exited the Container, but prior to fully opening.
Figure 10:
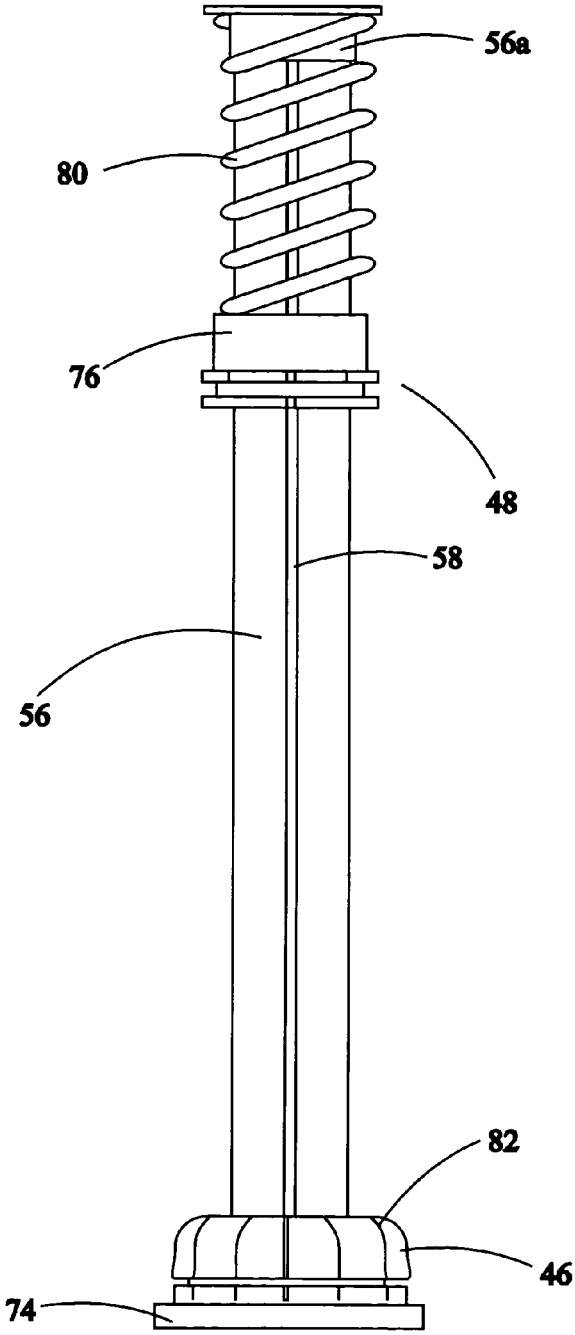
FIG. 10 shows a close up of a side view of the Upper Collar mounted on the Lower Collar.
Figure 11:
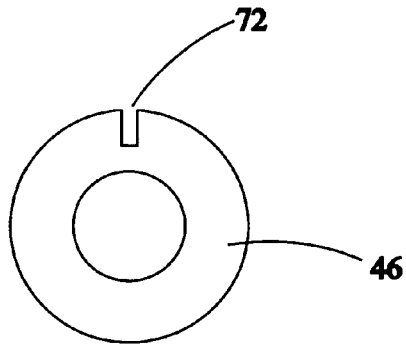
FIG. 11 is a bottom view of the Lower Collar.
Figure 12:
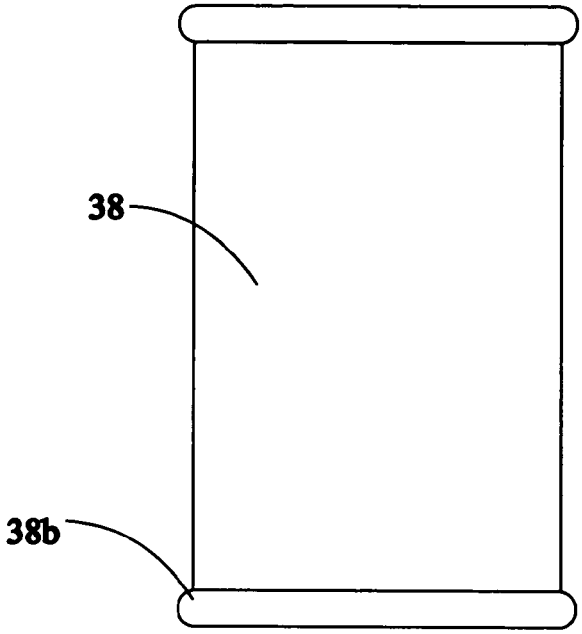
FIG. 12 is an exterior view of one form of Handle.
Figure 13:
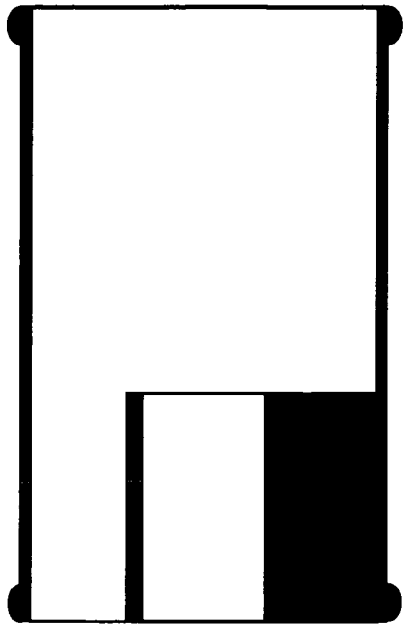
FIG. 13 is an interior, cutaway view of one form of Handle.
Figure 14:
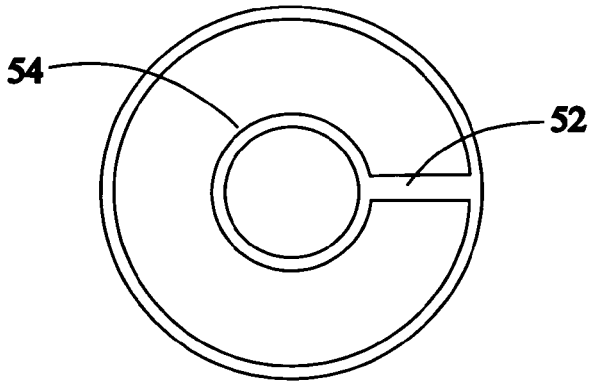
FIG. 14 is a bottom view of one form of Handle.
Figure 15:
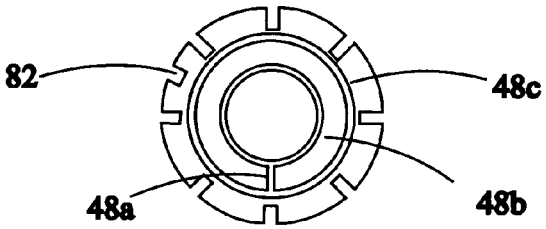
FIG. 15 is a top view of the Upper Collar.
Figure 16:
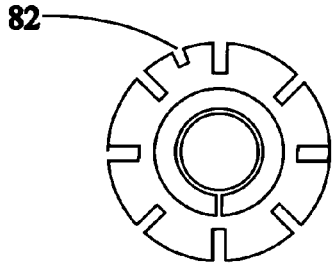
FIG. 16 is a bottom view of the Upper Collar.
Figure 17:
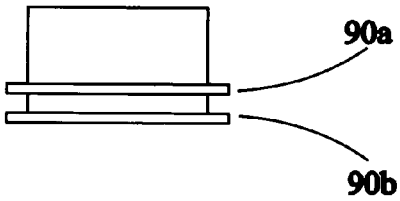
FIG. 17 is a side view of the Upper Collar.
Figure 18:
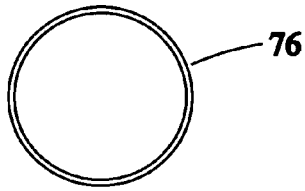
FIG. 18 is a top view of the Upper Collar Ring.
Figure 19:
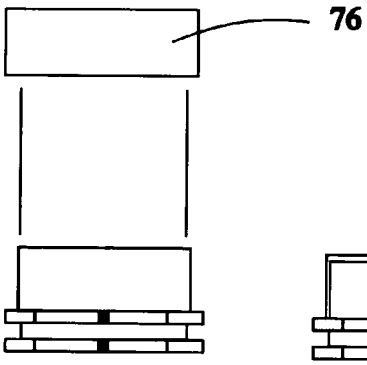
FIG. 19 demonstrates how the Upper Collar Ring surrounds the Upper Collar exterior wall.
Figure 20:
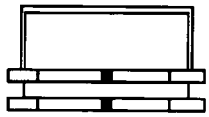
FIG. 20 is a side view showing the Upper Collar Ring mounted on the Upper Collar.
Figure 21:
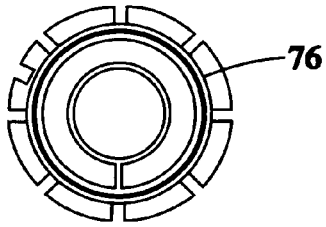
FIG. 21 is a top view showing the Upper Collar Ring mounted on the Upper Collar.
Figure 22:
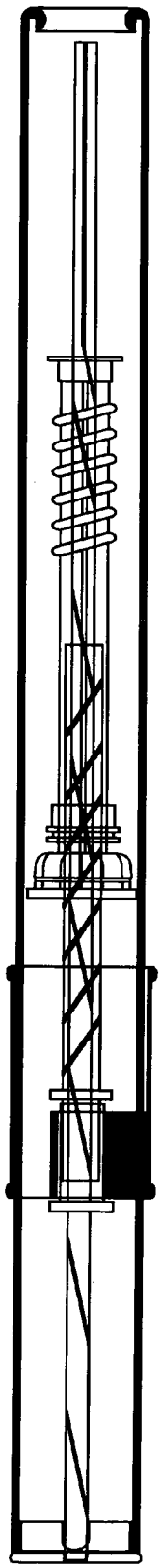
FIG. 22 is a skeleton view of the elements of the mechanism inside the Container.
Figure 23:
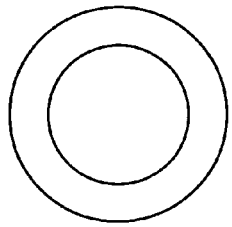
FIG. 23 is a bottom view of Rotatable Rod Lower Lip-Cap.
Figure 24:
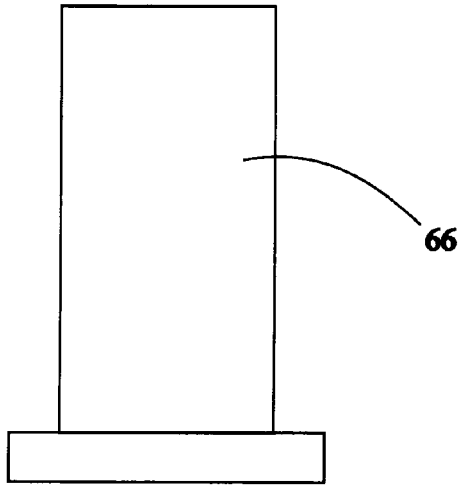
FIG. 24 is a side view of Rotatable Rod Lower Lip-Cap.
Figure 25:
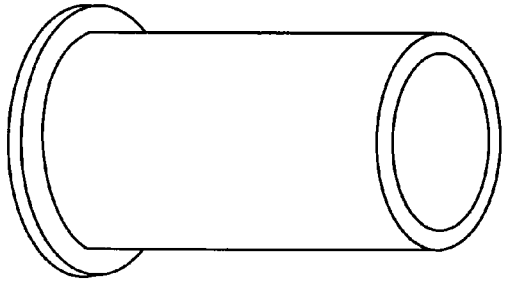
FIG. 25 is a perspective view of Rotatable Rod Lower Lip-Cap.
Figure 26:
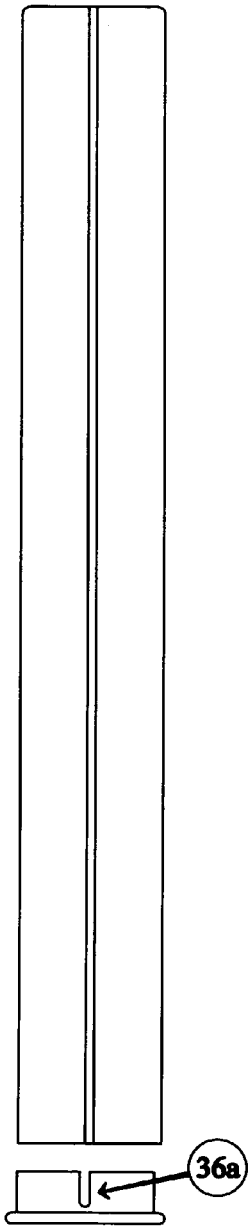
FIG. 26 shows the Base separated from the Container.
Figure 27:
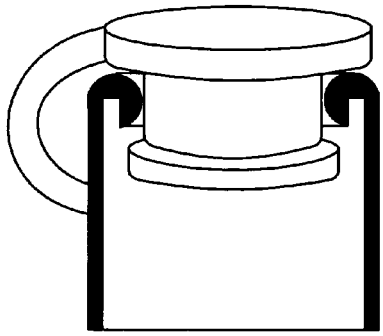
FIG. 27 shows a form of Container Stopper.
Figure 28:
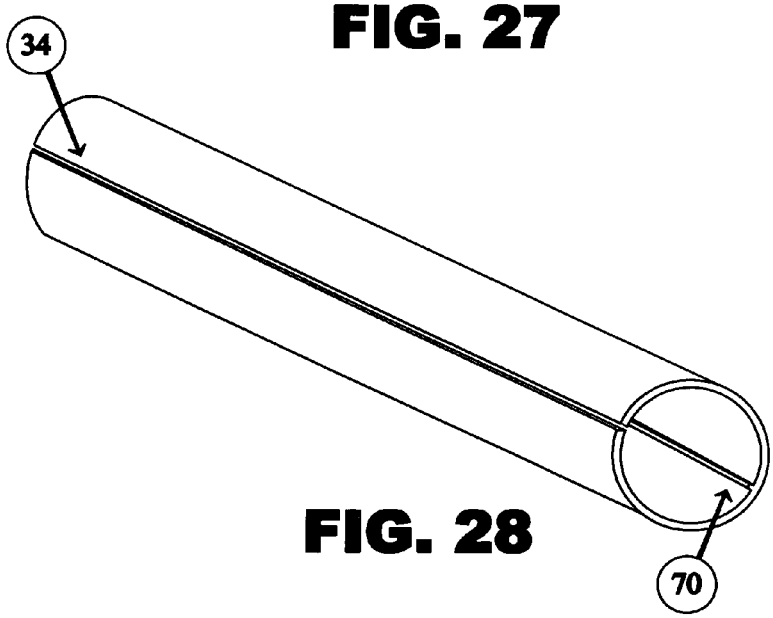
FIG. 28 is a perspective view of a Container.
Figure 29:
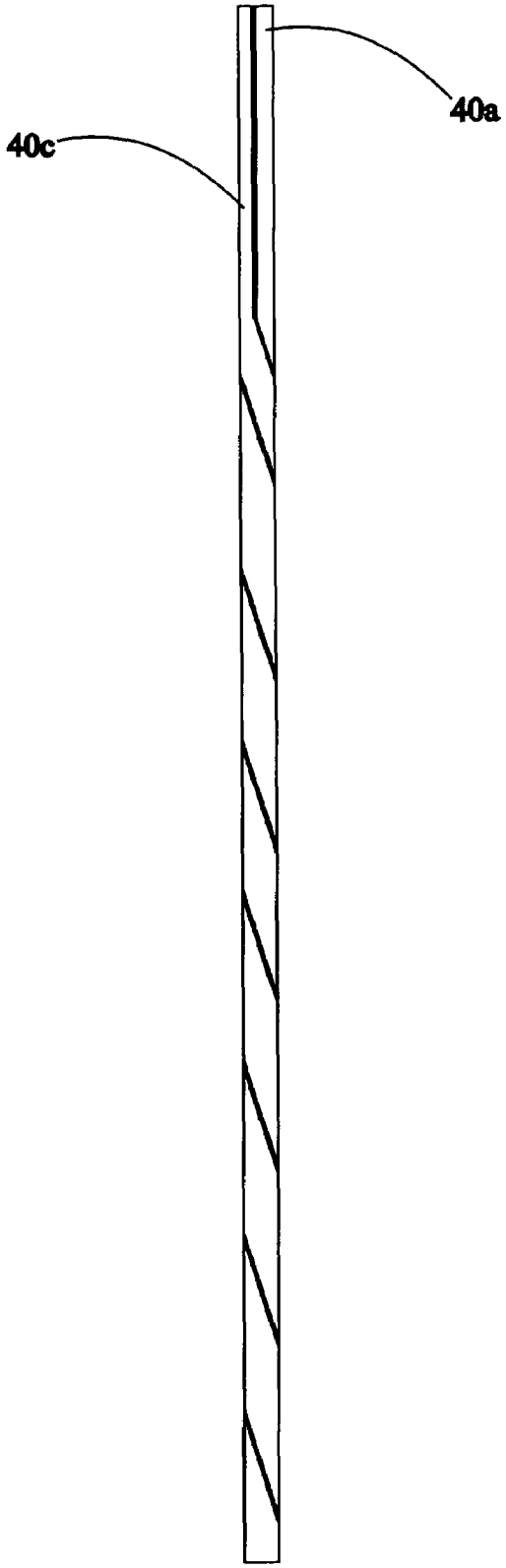
FIG. 29 is a side view of an Actuation Shaft.
Figure 30:
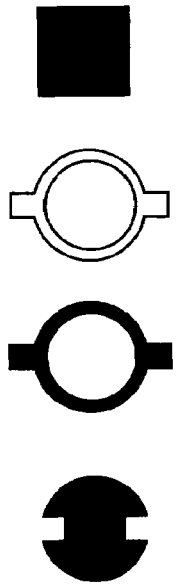
FIG. 30 is a top view of an Actuation Shaft with Helical Lands and Grooves, and the square represents a square rod twisted in a helical form
Figure 31:
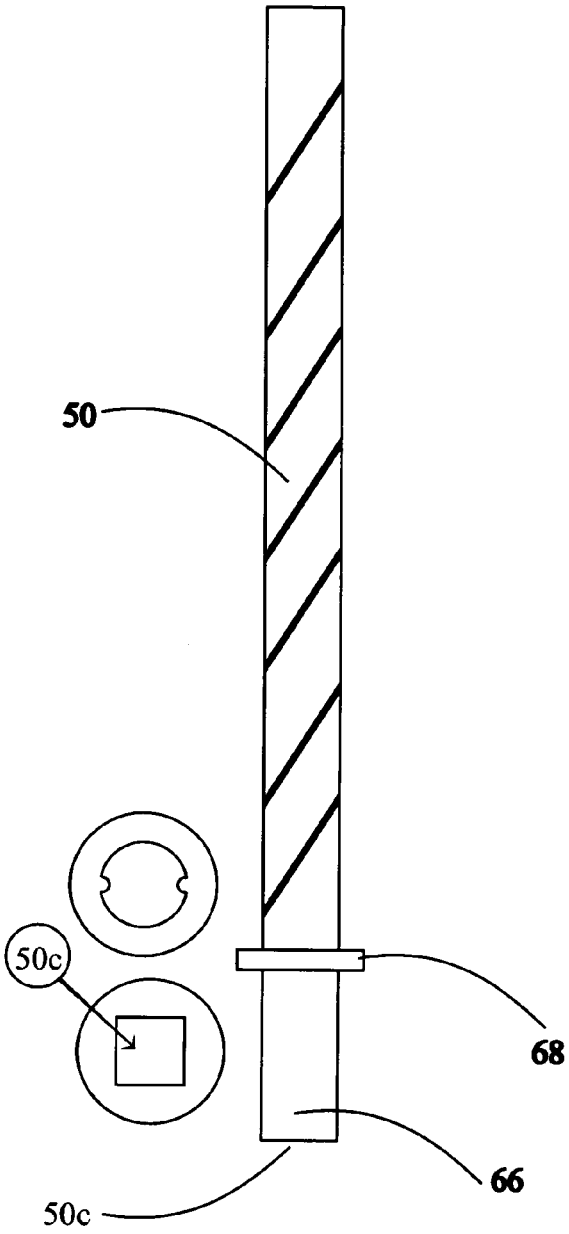
FIG. 31 is a side view of Rotatable Rod.
Figure 32:
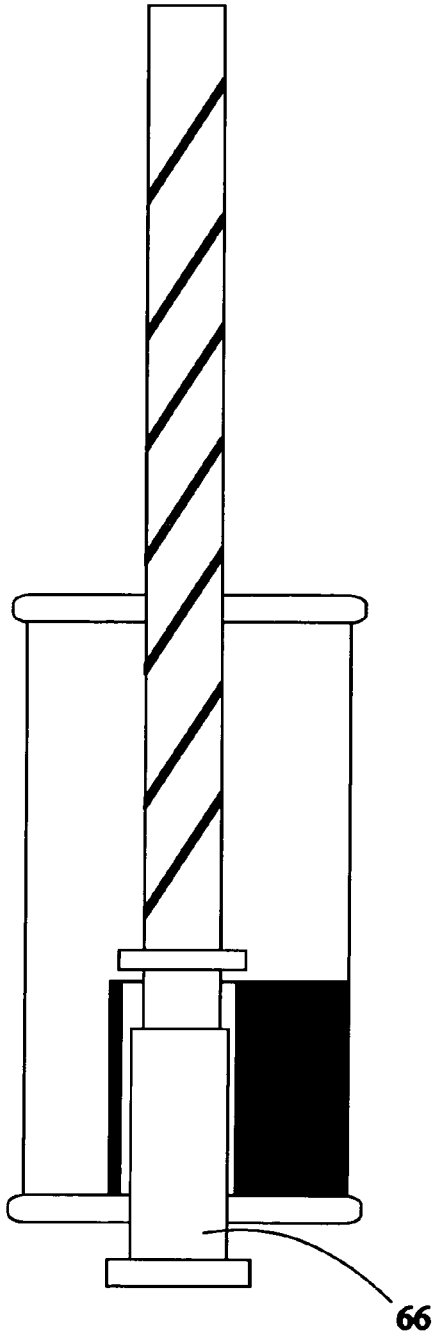
FIG. 32 is a side, interior view of the relationship between Rotatable Rod, Lower Lip-Cap and Handle.
Figure 33:
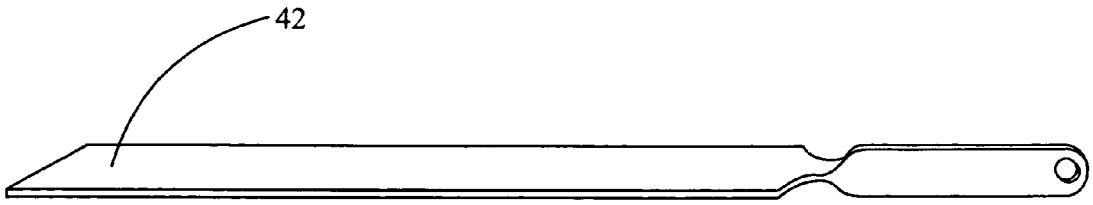
FIG. 33 illustrates a rib format which is flat, unchannelled and strong, having a twist to permit its attachment to the Upper Collar.
Figure 34:
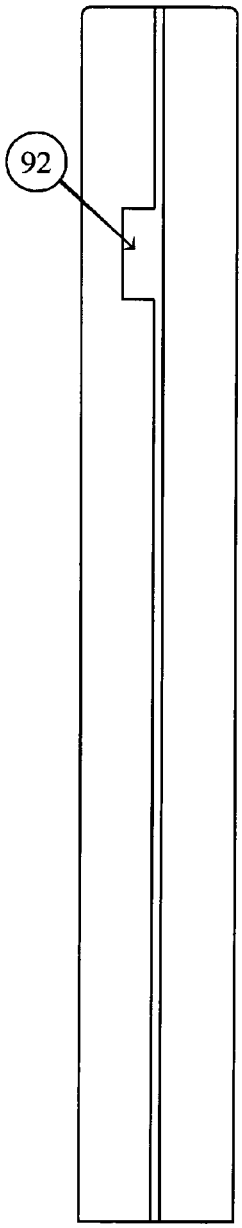
FIG. 34 illustrates an optional Container Open Frame Lock
Figure 35:
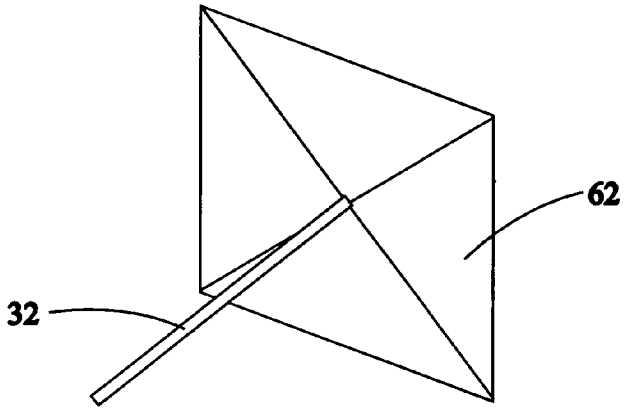
FIG. 35 discloses one method relating to how a wall screen might function.
Figure 36:
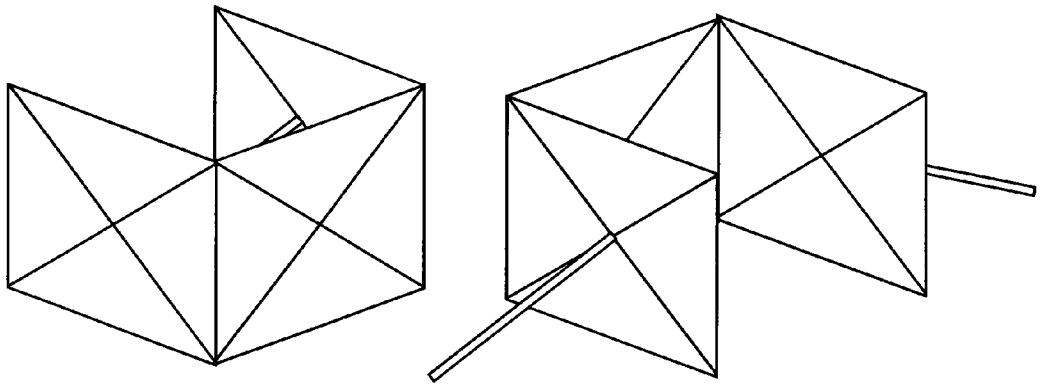
FIG. 36 illustrates how multiple wall screens may be used in coordination together.
Figure 37:
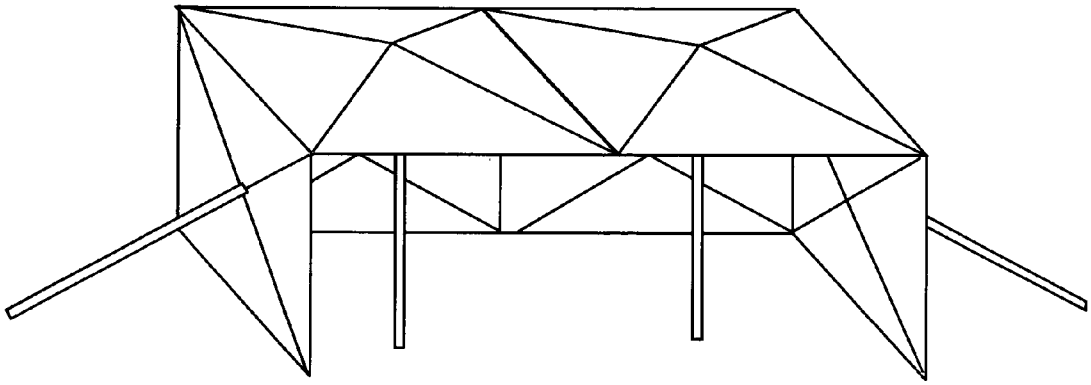
FIG. 37 discloses a tent like structure using multiple wall screens.

28 Frame
32 Container
32*a* Container Upper End
32*b* Container Lower End
34 Container Slit
36 Base
36*a* Base Slit
38 Handle
38*a* Handle Bottom End
38*b* Handle Lip
40 Actuation Shaft
40*a* Actuation Shaft Upper End
40*b* Actuation Shaft Helix Configuration
40*c* Actuation Shaft Discontinued Helix
42 Main Ribs
42*a* Pivotal Rib-Ends
42*b* Free Rib-Ends
44 Support Ribs
44*a* Pivotal Rib-Ends
44*b* Intermediate Rib-Ends
46 Lower Collar
48 Upper Collar
48*a* Upper Collar Bridge
48*b* Upper Collar Inner Ring
48*c* Upper Collar Wall
50 Rotatable Rod
50*a* Rotatable Rod Upper End
50*b* Rotatable Rod Lower End
50*c* Rotatable Rod Lower End Aperture
50*d* Rotatable Rod Helix Configuration
52 Handle Bridge
54 Handle Bridge Inner Ring
56 Stabilizing Pole
56*a* Stabilizing Pole Cap
58 Stabilizing Pole Slit
60 Annular Rim
62 Cover Material
66 Rotatable Rod Lower Lip-Cap
68 Rotatable Rod Upper Lip
70 Container Interior Land
72 Lower Collar Base Detent
74 Lower Collar Base Lip
76 Upper Collar Cover Ring
78 Tension Point
80 Tension Element (Spring)
82 Extra Slot
90*a* Upper Collar Lower Section Upper Lip
90*b* Upper Collar Lower Section Lower Lip
92 Container Open Frame Lock

DESCRIPTION OF THE PREFERRED EMBODIMENT

Disclosed herein is an elongated Container 32, which is preferably circular but which may also be of polygonal shape. Container 32 serves multiple functions including holding shaft for when Frame 28 is in the open position, and storage chamber for retracted Frame 28, as well as the elements of its projection/retraction mechanism, when Frame 28 is in the closed position. Container 32 is preferably fabricated out of strong, lightweight plastic or a metal such as aluminum. Lining the interior of Container 32 is a thin, straight, axial, inwardly-projecting, Land 70 whose width and depth is approximately $1/30^{th}$ the inner diameter of Container 32. It should run the full length of Container 32 and can be manufactured integral to Container 32 through an extrusion process which requires an extrusion die. (If any polygonally shaped embodiment of Container 32, is used, however, Land 70 is rendered unnecessary because the function of this land is to interact with Lower Collar Base Detent 72 to prevent Frame 28 from rotating. By using another shape, even an oval, Lower Collar Base Detent 72 is prevented from rotating by the shape of Container 32.)

Container Slit 34 is located 180 degrees opposite to the position of Land 70 in Container 32. Container Slit 34 runs the longitudinal length of Container 32, thereby providing a gap whose width is approximately $1/30^{th}$ the inner diameter of Container 32. Container Slit 34 is either formed during the manufacture of Container 32, a process requiring a special extrusion die, or it is cut using precision cutting tools after a solid Container 32 is produced. Both Land 70 and Container Slit 34 should be extremely smooth, and precisely straight. Both lead to an inwardly-projecting Annular Rim 60 on container Upper-End 32*a*. Upper End 32*a* defines an opening in Container 32 through which Frame 28 is projected and retracted. Container Lower End 32*b* is closed by an attachable base 36 which has a Base Slit 36*a* in it that corresponds in its positioning with Container Slit 34.

Attachable Base 36 also functions as a stabilizing support structure for Actuation Shaft 40 which is a preferably solid, elongated shaft. Base 36 is attached using a type of glue specifically for joining metallic parts and preferably aluminum parts, or, if manufactured of plastic, is attached by sonic welding. Either a loop or a curved handle may also, optionally, be attached to the exterior facing surface of Base 36 for use in carrying Container 32 or for suspending it from a support structure.

Container 32 is of such dimension, both in cross section and length, to telescopically receive within it a plurality of Frame 28 Main Ribs 42. Main Ribs 42, preferably numbering eight, are made in the form of a solid rod of material, as opposed to conventional, channeled ribs. Further, they are made of a rust-resistant material such as aluminum or plastic. Main Ribs 42 have Pivotal Rib-Ends 42*a* pivotably mounted on Upper Collar 48. Free Rib-Ends 42*b* are unmounted on any collar and are adapted to accommodate the attachment to them by a portion of the border edge of Cover Material 62. Support ribs 44 are equal in number to main ribs 42. Support Ribs 44 also have their Intermediate Rib-Ends 44*b* adapted to attach to an intermediate point on a corresponding Main Rib 42. The other, opposite set of Mounted Rib-Ends 44*a*, are pivotably mounted to Lower Collar 46. All pivotably mountable rib-ends which are mounted on either of the two collars are attached in a manner radiating about the circumferences of the collars. The mountable, pivotable rib-ends can be attached to their respective collars either by the conventional method using a wire threaded through eyelets in the tips of the pivotal rib-ends, or via a method in which the ribs are individually attached through some form of pivot-hinges that pivotably hold the ribs in slots in the collars. Each intermediate Rib-End 44*b* can be attached to its corresponding, respective Main Rib 42 in the conventional manner using a pivotal joint. In the containerized, stored condition, all the rib-ends fall along the longitudinal axis of both Container 32 as well as Stabilizing Pole 56.

Stabilizing Pole 56 is preferably circular, but may be of polygonal shape and is formed as an integral and central part of Lower Collar 46. The center of Cover Material 62 has a small hole whose inner diameter is large enough to surround the outer diameter of the upper wall of Upper Collar 48. Cover Material 62 is securely anchored to Upper Collar 48 by Upper Collar Cover Ring 76. Upper Collar 48 is slidably disposed along the axis of Stabilizing Pole 56. When Frame 28 is in the closed position, Upper Collar Cover Ring 76, the center of Cover Material 62, and Upper Collar 48 are all situated approximately at the lower end of Stabilizing Pole 56 which is a part of Lower Collar 46.

The opening process of Frame 28 starts when it is in the closed condition fully retracted and stored within Container 32. In the closed condition Main Ribs 42 are disposed within and coaxial of Container 32 with pivotable rib-ends 42*a* pivotably mounted on Upper Collar 48 and located below unmounted, Free Rib-Ends 42*b*. This condition is opposite to that of conventional, traditional umbrella frames. Support Ribs 44, also coaxial of Container 32, have a set of Pivotal Rib-Ends 44*a* mounted to Lower Collar 46 and positioned below their Intermediate Rib-Ends 44*b* which are attached to Main Ribs 42. This, further reflects a condition opposite to that formed by conventional frames.

Slidably disposed along the outside of Container 32 is Handle 38 whose main body shape conforms to the shape of Container 32. Handle 38 is manufactured using a plastic injection-molding process and is essentially hollow having an inner diameter sufficiently wide to surround the external diameter of Container 32 and in a preferred embodiment has a length approximately as great as that of an average adult human fist. Along its top and bottom exterior rims are Handle Lips 38*b*. Protruding inwardly from the interior wall of Handle 32 at Handle Bottom End 38*a* is Handle Bridge 52 which is sufficiently thin in width that it may fit into Container Slit 34 of Container 32. Handle Bridge 52 almost as long as a radius of Handle 38. It may not be exactly as long as a radius of Handle 38 because attached to Handle Bridge 52 at the center of Handle 38 is Handle Bridge Inner Ring 54.

Handle Bridge 52 should be made as thin as possible, since its thickness influences the thickness of Container Slit 34. Handle Bridge 52 slides within Container Slit 34 and, therefore, Container Slit 34 must be wide enough to accommodate the relatively easy slideability of Handle Bridge 52. Conversely, Container Slit 34 should be as narrow as possible to prevent water and other foreign matter from entering and getting trapped within Container 32. In determining the width and height of Handle Bridge 52, an account must be taken regarding the amount of pressure that Handle Bridge 52 needs to be able to withstand so that Handle Bridge 52 does not get torn away from Handle 38. The tensile strength of the material used in the manufacture of Handle 38, of which Handle Bridge 52 should be made an integral part, influences the height and width of Handle Bridge 52. For example, using plastics, the preferred material, nylon, would allow for the manufacture of a narrower bridge than a weaker form of plastic would allow. Testing indicates that manufacturing Handle 38 out of high-strength nylon allows for the height of Handle Bridge 52 to be at least as short as fifteen millimeters. The bottom of Handle Bridge 52 should be flush and even with one end of Handle 38, designated Handle Bottom End 38*a*. In the center of Handle 38, on the end of Handle Bridge 52, can be found Handle Bridge Inner Ring 54 manufactured integral to Handle 38. Handle Bridge 52 should be thick and strong enough to prevent Handle Bridge Inner Ring 54 from breaking-off. The wall thickness of Handle Bridge Inner Ring 54, should not exceed approximately 20 times the thickness of Handle Bridge 52.

The interior of Handle Bridge Inner Ring 54 interacts with the exterior of the main body of Lower Lip Cap 66. The main body of Lower Lip Cap 66 consists of an elongated portion whose smooth interior wall attaches below Upper Lip 68 to the exteriorly smooth, non-helical continuation of the main body of Rotatable Rod 50. Lower Lip Cap 66, whose exterior is smooth, and preferably cylindrical, serves to hold Handle Bridge Inner Ring 54 in contact with Rotatable Rod 50 during the projection/retraction process of Frame 28. The interior of Lower Lip Cap 66 is either smooth and joined to the exterior of Rotatable Rod Lower End 50*b* through gluing or a sonic welding process if Lower Lip Cap 66 is fabricated out of plastic, or its interior is comprised of a threading coactive with a corresponding threading on the exterior of Rotatable Rod Lower End 50*b*, if Lower Lip Cap 66 is fabricated out of metal. After its attachment thereto, Lower Lip-Cap 66 rotates as an integral part of Rotatable Rod 50.

To initiate the opening process that propels Frame 28 out of Container 32, Handle 38, located at Container Lower End 32*b*, is grasped, and moved axially in a linear fashion in the direction towards Container Upper End 32*a*. As this process starts, a linear force is exerted onto Rotatable Rod Upper Lip 68 by Handle Bridge Inner Ring 54 which is integrally connected by Handle Bridge 52 to Handle 38. As this linear pressure is applied against Upper Lip 68 by the movement of Handle 38, the configuration on the interior of Rotatable Rod 50 interacts with the exterior configuration of Actuation Shaft 40. The result of this interaction is that Rotatable Rod 50 is influenced to translate into rotary motion the pressure for linear movement effected on it by Handle 38. The exterior of Rotatable Rod 50 is also engineered with a helical configuration with the intent that the interaction between this exterior and the interior of Upper Collar 48 produces rotation in Upper Collar 48.

However, Upper Collar 48 is prevented from rotating. This is accomplished through the relationship between Upper-Collar Bridge 48*a* which is fit inside Stabilizing Pole Slit 58 which is an integral part of Stabilizing Pole 56, which is an integral part of Lower-Collar 46 which has Base Lip 74 which has Base Detent 72. Base Detent 72 interacts with container interior Land 70 which fits into Base Detent 72, and thereby initiates the serially interactive process of rotation prevention; Land 70 thwarts the rotation of Base Detent 72, which thwarts the rotation of Base Lip 74, which thwarts the rotation of Lower Collar 46, which thwarts the rotation of Stabilizing Pole 56, which thwarts the rotation of Stabilizing Pole Slit 58, which thwarts the rotation of Upper-Collar Bridge 48*a*, which, thereby, expressly prevents Upper Collar 48 from rotating. Thus, as the only response available in reaction to the pressure to rotate which Rotatable Rod 50 effects on it, Upper Collar 48 is compelled to move in a linear fashion along Stabilizing Pole 56 in the direction towards Stabilizing Pole Cap 56*a* (during the projection process). This means that, historically, Upper Collar 48 has been fixedly attached to a rod, one which is herein replaced by Rotatable Rod 50. The achieved goal via the object of this disclosure is to be able to disengage Upper Collar 48 from what traditionally has been a non-rotating rod in the position of Rotatable Rod 50 during the retraction process. With the Rotation of Rotatable Rod 50, Upper Collar 48 can move to the tip of Rotatable Rod 50 when projection is desired, and during the retraction process, Rotatable Rod 50 spins, thereby participating in the moving of Upper Collar 48 away from its top near Stabilizing Pole Cap 56*a*, which, thereby, permits Rotatable Rod 50 to, essentially, move "upwards" into the interior of the structure of Frame 28. By so doing, the traditionally fixed position of a non-rotating rod does is not required to occupy empty space which historically was dedicated exclusively for such a rod inside Container 32. During the retraction process, Handle 38 engages Rotatable Rod Lower Lip-Cap 66, which due to its attachment to Rotatable Rod 50, causes Rotatable Rod 50 to move. Because its interior is influenced by Actuation Shaft 40, Rotatable Rod 50 starts to rotate. Since Rotatable Rod 50, itself, has a helical configuration on its exterior wound in the opposite direction to that of Actuation Shaft 40, Upper Collar 48, which is influenced by the rotation of the exterior of Rotatable Rod 50, is compelled to move in the same direction as Handle 38. Since Upper Collar 48 is influenced, itself, to rotate, but is prevented from doing so, Upper Collar 48 is caused to move linearly along the exterior axis of Rotatable Rod 50. Moreover, both Rotatable Rod 50 and Upper Collar 48 are caused to move axially in the same direction. This is accomplished through a mechanically engineered design imparting opposite rotational directions of the exterior rotation-producing configurations of Rotatable Rod 50 and of Actuation Shaft 40. Therefore, if the exterior of Rotatable Rod 50 comprises a left-wound helical spline, the exterior of Actuation Shaft 40 comprises a right-wound helical spline.

As Upper Collar 48 moves, it also causes Main Ribs 42 mounted around its circumference to move in concert. This, in turn, causes Support Ribs 44 to move as well, due to their attachment by intermediate Rib-Ends 44*b* to Main Ribs 42. Since Pivotal Rib-Ends 44*a* are attached to Lower Collar 46, of necessity, Lower Collar 46 also moves axially within Container 32. Lower Collar 46 moves in concert with Upper Collar 48 until the condition is reached wherein Lower Collar Base Lip 74 abuts Annular Rim 60 at Container Upper End 32*a*. At this point, Lower Collar 46 is prevented from moving any further because Annular Rim 60 serves as a barrier preventing Frame 28 from exiting Container 32 and keeping Lower Collar 46 within Container 32. At this point, Stabilizing Pole 56 is substantially protruding outside of Container 32, and serves to impart a condition of stability to Frame 28 in its open position. This is a more stabilized condition than if Stabilizing Pole 56 were not employed.

Both Rotatable Rod 50 and Actuation Shaft 40 are preferably made of some kind of strong, lubricated plastic. One skilled in the art will recognize that this refers to a plastic having friction-reducing properties, and does not suggest the smearing of the plastic with a lubrication, although in some possible instances this might, potentially be valuable. The exterior rotation-conferring configuration on Actuation Shaft 40 may comprise a circular, screw/corkscrew type configuration, but it preferably comprises a solid spline of polygonal shape, preferably and elongated, square rod which is "twisted". The exterior helical spline configuration on Actuation Shaft 40 is constant until approximately ⅓ of the distance leading up to Container Upper End 32*a* at which point the helical configuration is discontinued. The section of Actuation Shaft 40 with the discontinued helix configuration, Actuation Shaft Upper End 40*a*, is not helical because it should not influence the rotation of any other interactive elements in contact either directly or indirectly with Actuation Shaft 40. (This discontinued helix configuration section is located closer to Annular Rim 60 than base 36.) Rotatable Rod 50 is concentrically disposed along the axis of Actuation Shaft 40. The main body of its exterior configuration comprises a high helix in the form of a square spline. On the interior of Lower End 50*b* is an aperture at the lower end of Rotatable Rod 50 lower conforming in shape to the preferred spline embodiment of Actuation Shaft 40. Thus, since, in a preferred embodiment, Actuation Shaft 40 is a spline of square shape, the base of the lower end of Rotatable Rod 50 of the Lower End 50*b* is also square. The exterior of Lower End 50*b* beneath Upper Lip 68 is smooth and cylindrical. The interior configuration of Rotatable Rod 50 is cylindrical, but must not inhibit the capacity for Rotatable Rod 50 to rotate as a result of its contact with Actuation Shaft 40. Since, in a preferred embodiment, Actuation Shaft 40 has its exterior helical spline discontinued, the height of the Interior Aperture 50*b* (which functions as the primary contact point for Rotatable Rod 50 and Actuation Shaft 40) should not exceed approximately ½ the measure of one of the pitches along the exterior of Actuation Shaft 40. To avoid excessive play in the interaction between Actuation Shaft 40 and Rotatable Rod 50, the inner diameter of the interior cylindrical wall of rotatable rod 50 is designed to be in extremely close proximity to the outer diameter of the blunted/slightly rounded corner edges of square Actuation Shaft 40. Upper Collar 48 is concentrically disposed along, and has Inner Ring 48*b* engageable with the axis of Rotatable Rod 50. The configuration of Inner Ring 48*b* conforms in shape to that of the exterior of Rotatable Rod 50. Thus, in a preferred embodiment, as the exterior of Rotatable Rod 50 is similar to the exterior, helical configuration of Actuation Shaft 40, Inner Ring 48*b* is of a square shape. (In an embodiment in which Rotatable Rod 50 has a helical configuration that is not discontinued, Inner Ring 48*b* can have an interior which conforms to the exterior configuration of Rotatable Rod 50 and a height greater than ½ the measure of the one of the pitches along the exterior of Rotatable Rod 50.)

There must be a sufficient spacing remaining between the exterior diameter of Inner-Ring 48*b*, and the interior of Upper Collar Wall 48*c* to accommodate the easy passage of Stabilizing Pole 56. The exterior of Upper Collar 48 is preferably circular having an upper section and a lower section. The lower section, in a preferred embodiment, is comprised of an Upper Lip 90*a* and a Lower Lip 90*b* defining a space wide enough to accommodate a conventional umbrella rib-holding wire. This lower section outer diameter is less than that of the main body of Lower Collar 46. The reason for this is that in the stored position, Support Ribs 44 circumferentially attached to Lower Collar 46 must be able to reach an essentially vertical position to permit the retraction of Frame 28 into Container 32. If the outer dimension width of Upper Collar 48 is the same or a greater than that of Lower Collar 46, then Support Ribs 44 circumferentially attached to Lower Collar 46 will not be able to reach an essentially vertical position, and will, thus, thwart the retraction of Frame 28 into Container 32. The inner diameter measurement of Upper Collar Wall 48*c* should be greater than the outer diameter of Stabilizing Pole 56.

A number of slots wide enough to accommodate the width of Pivotal Ends 42*a* or 44*a* are cut in a corresponding vertical manner into the circumference of both the upper and lower lips of the lower section. The number of slots is one greater than the number of attachable ribs. This Extra Slot 82 functions to provide a nook for the two ends of the rib-holding wire which are twisted together forming one closure end after all the ribs are wire-threaded and placed in the slots around the circumference of Upper Collar 48. A similar condition exists around Lower Collar 46 to which Main Ribs 42 are attached.

The upper section of Upper Collar 48 is approximately 2-3 times the height of the distance between the bottom of the lower lip to the top of the upper lip. Its circular, exterior wall, Upper Collar Wall 48*c*, functions to accommodate the attachment of a ring whose inner diameter is wide enough to encompass the "lipless" Upper Collar 48 upper section exterior. Upper Collar Cover Ring 72 functions to secure the hole in frame Cover Material 62 so that during the retraction of frame 28 back into Container 32, Cover Material 62 will remain in contact with Upper Collar 48 and will not separate away from Upper Collar 48 which, if separation were to occur, would cause a "riding up" or bunching up of Cover Material 62 which would prevent the orderly retraction of Frame 28 and Cover Material 62. Upper Collar Cover Ring 72 can be attached with a strong glue. The relationship between stationary Actuation Shaft 40, Rotatable Rod 50 and Upper Collar 48 is that the helical or twisting ratios of the pitches along the exteriors or Actuation Shaft 40 and Rotatable Rod 50 are such that they are approximately 2:1 in relation to each other. Therefore, if the pitch ratio of the helical spline configuration on Actuation Shaft 40 is 20 units of length, then the pitch ratio of the helical spline configuration on Rotatable Rod 50 is 10 units of length.

The interior-facing portion of Annular Rim 60 must have a smooth surface to prevent the tearing of Cover Material 62 as Frame 28 is produced out of and retracted into Container 32. Annular Rim 60 may be riveted, glued or threaded on its interior in order to effect its attachment to the exterior of Container 32. It may also be produced integral to Container 32 forming an internal stop at Container Upper End 82. At the point at which Lower Collar Base Lip 74 abuts Annular Rim 60, Handle 38 has traveled approximately ⅔ the length away from Container Lower End 28. The ratio of the degree of movement between Upper Collar 48 and Handle 38 until this point being that for every one unit of distance that is moved by Handle 38 along Container 32, approximately two units of distance are moved by Upper Collar 48 along Rotatable Rod 50. This formula is applied during the first (in opening process) and last (in closing process) approximately ⅔ the length of Container 32.

As Lower Collar Base Lip 74, abuts Annular Rim 60, Upper Collar 48 rests on Rotatable Rod Upper End 50*a*. Moreover, Handle 38 and Rotatable Rod Lower Lip/Cap 66 are situated at a point along Container 32 approximately ⅔ the distance away from Container Lower End 28. It is at this area on Actuation Shaft 40, that the rotation effecting configuration is discontinued. This discontinuation is accomplished by reducing the helical/spline formation along the exterior of Actuation Shaft 40 to the point where its exterior axis becomes a straight vertical for the last approximate ⅓ of its length. This is done with the express intention of discontinuing the rotational pressure which is exerted on Rotatable Rod 50 during the first (in the opening process) and last (in the closing process ) approximate ⅔ of the movement of Handle 32.

Thus, in the projection process, for example, for the last approximate ⅓ of the distance that Handle 38 moves from Container Lower End 28 towards Container Upper End 82, the pressure exerted on Rotatable Rod 50 is purely vertical and non-rotational. The absence of rotation in Rotatable Rod 50 is desirable at this point in the projection/retraction process since the goal of the rotation, causing Upper Collar 48 to reach and stay on Rotatable Rod Upper End 50*a*, is already achieved. At the point at which Upper Collar 48 rests on Rotatable Rod Upper End 50*a*, Frame 28 has substantially exited Container 32. It still, however, has not blossomed out into the open position. Handle 38 has already traveled approximately ⅔ the distance along the length of the exterior of Container 32. Upper Collar 48, at this point, is designed to move in equal units of distance in relation to Handle 38 as they continue to move away from container lower end 28 as part of the opening process. Upper Collar 48 must move a certain amount of distance away from Lower Collar 56 in order to cause frame 28 to open fully. This variable distance determines the approximate length of the straight, discontinued section of the rotation configuration on Actuation Shaft 40 as well as influences the length of Stabilizing Pole 56. In a preferred embodiment where the length of Actuation Shaft 40 is 21 inches, testing has shown that variable optimal distance to be approximately 7 inches. As Handle 38 moves, it eventually propels Upper Collar 48 past tension point 78 located approximately ¾ of the way up stabilizing pole 56 away from Lower Collar 46. Frame 28 with attached Cover Material 62 blossoms open and then manifests a limp shape, as opposed to a "tight" form that traditional umbrellas manifest when fully opened and tension is imparted to the frame ribs and cover material. Frame 28 regains the tension necessary to form a tight canopy cover as a result of the resilience of Tension Element 80 which abuts Stabilizing Pole Cap 56*a* and exerts pressure on Upper Collar 48. The tension of Tension Element 80, which may be a spring, is sufficient to apply a slight downwards pressure on cover material 62 via the connection of cover material 62 to Upper Collar 48. The pressure must not be so great as to cause Upper Collar 48 to move downwards past Tension Point 78 thereby forcing Frame 28 to close, however. The appropriate tension by Tension Element 80 is what permits the frame cover to displaying a tight, and relatively unwrinkled appearance and to resist closure by wind.

Frame 28 is closed by means of a process that starts with an initial movement of Handle 38 towards Container Lower End 28. In so doing, Upper Collar 48 is caused to travel downwards past Tension Point 78. Handle 38 acts upon Upper Collar 48 as a result of their indirect connection via Rotatable-Rod 50. As Upper Collar 48 travels back towards Annular Rim 60, it passes Tension Point 78 and releases the tension imparted by Tension Element 80 to Cover Material 62 and Frame 28. This movement causes unmounted Free Rib-Ends 42*b* to be propelled towards each other in the direction away from the body of Container 32 thereby causing all the Free Rib-Ends 42*b* to vertically meet together at a central point outside Container 32 along the same linear axis as that of Container 32. Continued, further motion of Handle 38 in the direction towards container Lower End 28 accounts for the initiation of the process of bringing Frame 28 and Cover Material 62 back into Container 32. After Handle 38 has moved about ⅓ the distance away from Annular Rim 60 towards Lower End 28, the interaction of the exterior configuration on Actuation Shaft 40 and the interior of Rotatable Rod 50 causes Rotatable Rod 50 to rotate. Frame 28, therefore, is retracted through the reversal of the process which propelled it out of Container 32 and into the open position.

Upper End 82 has attached to it container Cover Cap 88 which can be made out of rubber or manufactured out of plastic through an injection molding process which also can produce a living hinge. It can function as a conventional tip of a crutch or cane, or can be shaped in metal. In any embodiment it may display an advertising logo.

ALTERNATE EMBODIMENT

In an alternate embodiment, Actuation Shaft 40 and Rotatable Rod 50 have exterior high-helical configurations 40*b* and 50*d* of are comprised of either lands or grooves or combination thereof. It is also possible, as well, for the interiors of Rotatable Rod 50 and Upper Collar 48 to have at least one or more inwardly protruding guide nubs or humps that can interact, respectively, in a corresponding manner with any high helix lands or grooves employed on Actuation Shaft 40 or Rotatable Rod 50. These nubs, if employed, would be located on the interiors of Rotatable Rod 50 on lower end 50*b*, and the rib-holding base of Upper Collar 48. In this alternate embodiment, one helical or splinal configuration can function adequately, however, since the more helical the configurations of the exteriors of Actuation Shaft 40 and Rotatable Rod 50, the more easy the rotation of Rotatable Rod 50 can be effected, 2-6 separately started fast or high helixes provide for less resistance to rotation when Handle 38 is manually operated.

Container 32 has at least one slight detent cut in the side of Container Slit 34 to accommodate the introduction of Handle Bridge 52 in order to serve to lock Handle 38 in a the fixed position.

While the above description contains many specificities, these should not be construed as limitations on the scope of the invention, but rather as an exemplification of one preferred embodiment thereof. It is apparent that changes and modifications can be made and equivalents substituted without departing from the invention. Other variations are possible. Accordingly, the scope of the invention should be determined not by the embodiments illustrated, but by the appended claims and their legal equivalents.

What is claimed is:

1. A multi-use frame structure and means for its projection-retraction from a container comprising:

a container;

a frame structure;

a rotatable motion conversion means active at least at some point during both the projection and retraction processes of said frame structure in relation to said container;

said motion conversion means further comprising actuation shaft means having helical torque transfer means;

a first rotatable member concentrically positioned with respect to said actuation shaft means and rotatable relative thereto having an interior configuration coactive with the exterior helical torque transfer means of said actuation shaft means and having an exterior helical torque transfer means including a configuration opposite to that of said actuation shaft means;

at least a second rotatable member concentrically positioned with respect to said first rotatable member having an interior configuration coactive with the exterior helical torque transfer means of said first rotatable member;

means to prevent the rotation of said at least one other rotatable member; and, drive means.

2. The mechanism as defined in claim 1, wherein:

said actuation shaft means includes a non-rotating, elongated, rod-like shaft centrally fixed within a container and coaxial therewith, having at least part of its exterior comprising at least one exterior helical configuration selected from the group consisting of splines and lands and grooves.

3. The mechanism as defined in claim 1, wherein:

said helical configuration or configurations of said actuation shaft means and said first rotatable member are wound high or fast and in directions opposing each other;

said first rotatable member exterior high helix pitch is less than that of said actuation shaft by approximately fifty percent;

said at least a second rotatable member includes a main body having a means to accommodate the attachment and stabilization of at least one component comprising said frame structure, and a means for holding a structure cover means fixedly in place including a ring means having an inner diameter greater than the outer diameter of said stabilizing pole and an exterior wall to accommodate the attachment of said stabilizing ring, an interior wall having at least one bridge leading to at least one concentric, tubular wall at least part of whose interior accommodates to the configurations of said first rotatable member exterior, said at least a second rotatable member being engageable with means to prevent its rotation, including a means selected from the group consisting of a non-rotating container base-end and a container interior axial land or groove and an essentially hollow, slitted stabilizing pole.

4. The mechanism as defined in claim 1, wherein:

said first rotatable member includes an elongated, tube having an interior at least part of which comprises at least one helical configuration selected from the group consisting of splines and lands and grooves and nub-guides and guides coactive with the exterior helical torque transfer means of said actuation shaft means;

said first rotatable member includes an exterior comprised of at least one helical configuration selected from the group consisting of splines and lands and grooves and nub-guides and guides and includes a base area comprising an integrally-manufactured, exteriorly protruding lip having a smooth lower body emanating from beneath said lip.

5. The mechanism as defined in claim 1, wherein:

said frame structure includes a second means to accommodate the attachment and stabilization of at least one component comprising said frame structure including a main body, a plurality of slots for accommodating the attachment of a plurality of frame component members, a base interactive with said container open-end rim wider than the primary body, a detent in said base, an elongated, hollow, stabilizing rod-like element manufactured integral to said second stabilization means including at least one axial slit along the longitudinal axis of said elongated stabilizing pole, a tension element adapted to surround the exterior of said elongated stabilizing pole to accommodate a bridge in said second rotatable member, a cap adapted to be attached to said stabilizing pole having and outer diameter greater than both the exterior of said elongated stabilizing pole and said Tension element.

6. The mechanism as defined in claim 5, wherein:

said tension element is a spring.

7. The mechanism as defined in claim 6, wherein:

said container is of cylindrical or polygonal shape and includes one open end having an inwardly directed annular shoulder, at least one axial slit, at least one interior land, one closed end including a base means to secure said actuation shaft means thereby preventing its rotation, and one container open-end cover-cap.

8. The mechanism as defined in claim 7, wherein:

said drive force means includes a force-delivering element having an inner diameter sufficiently large to encompass said shaped container and slidably disposed with respect thereto, engageable with but not fixedly attached to said first rotatable member via a narrow bridge that emanates from said drive-force interior and connects to an interior ring.

9. The mechanism as defined in claim 8, wherein:

said frame comprises a plurality of collars that have attached to them a plurality of ribs comprising an integral one-piece assembly.

10. The mechanism as defined in claim 9, wherein:

said frame is configured to receive a covering;

a covering.

11. A mechanism as defined in claim 1, wherein:

said motion conversion means comprises:

actuation shaft means having helical torque transfer means;

a first rotatable member concentrically positioned with respect to said actuation shaft means having an interior configuration coactive with the exterior helical torque transfer means of said actuation shaft means;

a drive means.

12. A mechanism as defined in claim 11, wherein:

the rotation-effecting properties of the actuation shaft means ceases to act to affect the rotation of other interactive elements along the last approximate ⅓ section of said actuation shaft means.

13. The mechanism as defined in claim 12, wherein:

said at least one container comprises at least one axial slit, one open end having an inwardly directed annular shoulder, one closed end including a base means to secure said actuation shaft means thereby preventing the rotation of said actuation shaft means, and one container open end cover-cap.

14. The mechanism as defined in claim 13, wherein:

said at least one container comprises at least an inwardly protruding land to prevent the rotation of said frame collar.

15. The mechanism as defined in claim 14, wherein:

said at least an inwardly protruding land runs coaxially substantially along the entire length of said at least one container.

* * * * *